US011958581B2

(12) United States Patent
Despineux et al.

(10) Patent No.: US 11,958,581 B2
(45) Date of Patent: Apr. 16, 2024

(54) DEVICE FOR SETTING THE DRIVE POSITION OF A BOAT

(71) Applicant: Torqeedo GmbH, Wessling (DE)

(72) Inventors: Frank Despineux, Wessling (DE); Moritz Mueller, Koenigsbrunn (DE)

(73) Assignee: Torqeedo GmbH, Wessling (DE)

( * ) Notice: Subject to any disclaimer, the term of this patent is extended or adjusted under 35 U.S.C. 154(b) by 333 days.

(21) Appl. No.: 17/388,663

(22) Filed: Jul. 29, 2021

(65) Prior Publication Data

US 2022/0033046 A1 Feb. 3, 2022

(30) Foreign Application Priority Data

Jul. 31, 2020 (DE) ..... 10 2020 120 323.3

(51) Int. Cl.
*B63H 21/21* (2006.01)
*B63H 21/17* (2006.01)

(52) U.S. Cl.
CPC ..... *B63H 21/213* (2013.01); *B63H 21/17* (2013.01); *B63H 2021/216* (2013.01)

(58) Field of Classification Search
CPC ..... B63H 21/17; B63H 21/213; B63H 2021/216
See application file for complete search history.

(56) References Cited

U.S. PATENT DOCUMENTS 2,326,796 A * 8/1943 Panish ..... F02D 25/00 74/30
9,039,468 B1 5/2015 Arbuckle et al.
9,828,080 B1 11/2017 Belter et al.
2003/0013354 A1 1/2003 Yanagihara
2012/0191276 A1 7/2012 Clever et al.
2013/0300588 A1 11/2013 Kuga
2014/0102241 A1 4/2014 Rao et al.
2018/0215456 A1* 8/2018 Ozaki ..... B63H 20/10

FOREIGN PATENT DOCUMENTS

CN 108069013 A 5/2018
CN 109484603 A 3/2019
CN 210793603 U 6/2020
DE 19652168 A1 6/1998
DE 102016121747 A1 5/2018
EP 2586696 A1 5/2013
EP 2899114 A1 7/2015
EP 3000717 A1 3/2016
(Continued)

OTHER PUBLICATIONS

Kwant Controls B.V.: Propulsion Control Unit: BUK-H DLH Product Sheet, www.kwantcontrols.com.
(Continued)

*Primary Examiner* — Stephen P Avila
(74) *Attorney, Agent, or Firm* — Greenberg Traurig, LLP; Roman Fayerberg; David J. Dykeman

(57) ABSTRACT

The present invention relates to a device (1) for setting the drive position of an electric drive of a boat, having a housing (14) with two receiving elements (15*a*, 15*b*) arranged on two opposing side walls (140) of the housing (14) for defining a pivot axis (17) and a drive lever (10) that can be pivoted around this pivot axis (17), wherein the drive lever (10) is received by two receiving elements (15*a*. 15*b*).

18 Claims, 5 Drawing Sheets

(56) References Cited

FOREIGN PATENT DOCUMENTS

| | | | | |
|---|---|---|---|---|
| EP | 3945016 | A1 * | 2/2022 | ..... B63H 21/17 |
| JP | H0452712 | H | 2/1992 | |
| JP | 2007303506 | A | 11/2007 | |

OTHER PUBLICATIONS

"Torqeedo Katalog 2009," 2009, 24 pages.
"Operating Manual Ultralight 402," Sep. 15, 2009, 64 pages.
"Torqeedo Katalog 2010," 2010, 24 pages.
"Torqeedo Katalog 2011," 2011, 24 pages.
"Torqeedo Katalog 2012," 2012, 32 pages.
"Torqeedo Katalog 2013," 2013, 21 pages.
"Torqeedo Katalog 2014," 2014, 46 pages.
"Torqeedo 2015," 2015, 64 pages.
"Torqeedo Electric Boating 2016," 2016, 74 pages.
"Operating Manual Ultralight 403," Mar. 22, 2016, 72 pages.
Güldenring, Sabine, "Service Manual Ultralight 403 and 1103," Mar. 23, 2016, 17 pages.
"Torqeedo Electric Boating 2017," 2017, 76 pages.
"Torqeedo Electric Boating 2018," 2018, 76 pages.
"Torqeedo Elektromobilität auf dem Wasser 2019," 2019, 76 pages.
"Ultralight 403 A/AC 1103 AC original operating instructions", Jan. 25, 2019, 131 pages.
Ultralight 403 A (320W) Drawing No. TQ-1405-00, Jan. 30, 2019, 1 page.
Ultralight 1103 AC (915Wh) Drawing No. TQ 1408-00_IND, Aug. 21, 2019, 2 pages.
Ultralight 1103 AC (915Wh) Drawing No. TQ 1408-000, Aug. 21, 2019, 1 page.
"Torqeedo Elektromobilität auf dem Wasser 2020," 2020, 72 pages.
"Addendum to the Ultralight 1103 AC User Manual," Jan. 13, 2020, Version 1.1, 2 pages.

* cited by examiner

DEVICE FOR SETTING THE DRIVE POSITION OF A BOAT

CROSS-REFERENCE TO RELATED APPLICATIONS

This application claims priority to and the benefit of German Patent Application No. DE 10 2020 120 323.3, filed Jul. 31, 2020, the contents of which is incorporated by reference in its entirety.

This application is also related to German branch-off utility model application No. 20 2020 107 195.5, filed Jul. 31, 2020, Community Design No. 008268379-0001, filed Nov. 13, 2020, Community Design No. 008268379-0002, filed Nov. 13, 2020 claiming the DE-priority of 20 2020 107 195.5 and U.S. Design Application No. 29/768,628, the contents of each of which are incorporated by reference in their entireties.

TECHNICAL FIELD

The present invention relates to a device for setting the drive position of a boat, preferably for setting the drive position of an electric motor driving the boat, and a boat with such a device.

PRIOR ART

It is known to drive boats with an electric motor. It is further known to control the drive position of the electric motor of the boat drive by means of a device for setting the drive position, wherein the setting of the drive position is for example realized through setting the power and/or the torque and/or the RPM ("rounds per minute") of the electric motor.

A device for setting the drive position can be provided directly on the electric boat drive, for example in the form of a rotary switch on a tiller of an electric outboard engine.

It is further known to provide devices for setting the drive position where a device arranged at a distance from the electric boat drive to be controlled is provided, by means of which the drive position of the electric motor of the boat drive can then be set. Such devices for setting the drive position are also described as drive lever or remote throttle.

A remote throttle is normally arranged on the control stand of a boat, so that the same can be operated easily by a skipper whilst driving. A remote throttle is in particular used when the motor is installed inaccessibly in the boat—for example a shaft-driven integrated motor, as an integrated motor with a Z drive, as an integrated motor with a sail drive or as a pod drive arranged substantially below the boat. A remote throttle can however also be used for controlling an outboard engine. The drive position of the controlled electric drive is usually continuously variable in line with the position of the respective drive lever here.

Several remote throttles arranged in different positions on the boat, for example at two different control stands or on the tiller and on the control stand, can also be provided for controlling a boat drive.

Such devices normally have a housing that is rigidly connected with the boat for setting the drive position and a manually actuatable drive lever that is pivotably fitted on the housing. Hereby, the drive lever is fitted on one side of the housing and is for example mounted in the housing via an axis protruding into the housing, which is pivotably held in the housing, which constitutes a complex and costly connection and sealing of drive lever and housing.

During a pivot movement in relation to the pivot axis this axis of the drive lever acts on a drive sensor, for example in the form of a potentiometer, so that a control signal can be generated, by means of which the power electronics of the electric motor of the boat drive can then be controlled. The positioning of the drive lever accordingly allows the operator to set the drive position, at which the electric drive is to be operated. In a zero position of the drive lever the electric drive stands still. A manual actuation of the drive lever from the zero position will operate the electric drive in a drive position corresponding to the drive position set by the drive lever.

Such devices also normally include a reversing position of the drive lever for setting a reverse running of the electric drive. The reversing position can be set by moving the drive lever from the zero position into a direction opposing the above mentioned forward operating range here. The drive unit, normally a propeller, of the electronic drive generates propulsion corresponding to the position of the drive lever, which acts in the opposite direction of the propulsion generated during forward driving.

DESCRIPTION OF THE INVENTION

Based on known prior art it is the object of the present invention to provide a simplified device for setting the drive position of an electric motor of a boat.

The object is solved by a drive arrangement with the features of claim 1. Advantageous further embodiments result from the subclaims, the enclosed Figures and this description.

Accordingly, a device for setting the drive position of an electric motor of a boat, having a housing with two receiving elements arranged on opposing side walls of the housing for defining a pivot axis and a drive lever that can be pivoted around this pivot axis is suggested, wherein the drive lever is received by both receiving elements.

A receiving of the drive lever with both receiving elements can realize that the drive lever itself can be implemented particularly simply and an advantageous connection with the housing can be achieved.

According to one embodiment example the drive lever has two identically shaped legs, which are connected with each other via a connecting bridge, wherein the two legs each have a recess. The receiving elements receive the drive lever with the recesses, so that the drive lever can be pivoted in relation to the pivot axis. The legs are preferably arranged mirror symmetrically to each other.

In one example the recesses are arranged in a lower area of the legs, wherein the lower area of the legs extends substantially vertical to the pivot axis. Such a twin-leg, single-piece implementation of a drive lever allows a simple fitting of the drive lever to the housing. A complex constructive mounting of the drive lever in the housing is not necessary.

In other words, the pivot axis of the drive lever is formed by the geometric connection line between the two receiving elements and extends transverse to a central plane of the housing, wherein the central plane lies in the middle of two side walls opposing each other. The receiving elements are arranged to symmetrically oppose each other in relation to the central plane and form the pivot axis of the drive lever. In one embodiment example the central plane extends in a longitudinal direction of the boat on which the device is arranged.

The housing describes a space for accommodating components required for the device. The housing consists of two side walls lying opposite each other, an upper side wall, a front side wall and a rear side wall. The side walls for example extend substantially parallel to the central plane. The front side wall and the rear side wall for example extend substantially transverse to the central plane. The upper side wall is a wall closing off the side walls and the front and rear side walls, which close the housing off at the top. A lower side lies opposite the upper side, wherein the housing is open on the lower side, e.g. has no lower side wall.

The above mentioned object is also solved by a device for setting the drive position of an electric drive of a boat, having a housing with a receiving element arranged on a side wall of the housing, for defining a pivot axis, wherein the pivot axis extends through the receiving element, and a drive lever received on the housing for pivoting around this pivot axis. According to the invention the drive lever has a leg, wherein the drive lever can be pivoted in relation to the pivot axis and the drive lever can be clicked onto or into the receiving element of the housing.

In this way an advantageous implementations can also be realized with a drive lever that has only one leg.

In one embodiment example the receiving elements are implemented as projections in the side walls. Alternatively, the receiving elements can also be implemented as recesses, wherein the legs therefore have matching projections to engage the recesses.

According to one embodiment example the drive lever can be clicked onto the receiving elements of the housing. Alternatively, the drive lever can be clamped onto the receiving elements of the housing, e.g. the drive lever is held on the housing only due to the identically shaped legs. In one embodiment example the legs are of a flexible bending implementation for clamping the legs onto the receiving elements. This fixes the drive lever in an axial direction of the pivot axis. A simple and cost-effective connection of the drive lever can be provided with such a click connection or clamping connection of the drive lever. A complex constructive mounting of the drive lever in the housing as well as mounting elements, for example for axial securing, can be omitted.

In a further embodiment example, the drive lever is implemented as a single-piece. In a further embodiment example, the legs are connected with the connecting bridge by means of form or material closure. The legs and the connecting bridge can for example be arranged in such a way that these form a U-shape or a trapezoidal shape. In a preferred embodiment example, the legs are so elastic that they can be bent easily in order to be pushed or clamped onto the receiving elements. The insides of the legs, e.g. the sides that point into the direction of the central plane, are in contact with the side walls of the housing. If the legs are pushed onto the receiving elements, these will hit against the respective side wall of the housing with their inside.

In one embodiment example the insides of the legs and the areas of the side walls of the housing that are in contact with the insides of the legs are coated in such a way that the inside of the legs slide along the housing in a desired way. Alternatively, the insides of the legs can also be distanced from the side walls of the housing.

According to one embodiment at least one magnet is arranged in the drive lever and at least one sensor in the housing in order to record the position change of the drive lever in relation to the pivot axis in a contact-free way. The position change is transmitted to a control unit. Based on the determined position of the drive lever the electric drive is controlled with a set power and/or torque and/or RPM. The housing can accordingly be completely hermetically closed and/or sealed, so that the device is implemented particularly robustly overall.

In one embodiment example the magnet is arranged concentrically to the pivot axis. If the drive lever is pivoted the (Hall) sensor calculates the rotation of the magnetic field and therefore calculates the change of the drive lever in relation to a zero position. Depending on the change of the drive lever and the change of the magnetic field resulting from the same, a power is set for the electric drive. The control unit controls the electric drive according to the power setting for the calculated change rotation of the magnetic field.

In an alternative example the magnet is arranged eccentrically to the pivot axis. The sensor calculates the path the magnet has travelled along a circular path in relation to the pivot axis. The control unit controls the electric drive according to the power setting for the calculated position change or the path travelled by the magnet. The setting of the power of the electric drive is further also to be understood as the setting of the torque and/or the RPM.

In one embodiment example the magnet is a diametral magnet or a diametral magnetized magnet. e.g. a magnet where the magnetization occurs around the circumference, so that a half-shell is magnetized as a north pole and the opposite half-shell accordingly as a south pole. This embodiment allows the magnet to be arranged concentrically to the pivot axis. The current rotation position of the drive lever can then be read out in a contact-free way by means of a Hall sensor arranged in the housing without having to produce a break-through in the housing. Correspondingly the housing can be completely hermetically closed and/or sealed, so that the device is implemented particularly robust overall. This means that complex rotation guides and rotation seals can be omitted.

In a further alternative embodiment, the drive lever can be connected with a potentiometer. Through a pivot movement in relation to the pivot axis this axis of the drive lever of the potentiometer acts in such a way that a control signal can be generated, by means of which the power electronics of the electric motor of the boat drive can then be controlled. The coupling between a potentiometer arranged in the housing and the drive lever can for example be magnetic, so that a break-through in the housing is not necessary.

According to one embodiment the recesses of the legs of the drive lever form a snap & click connection with the receiving elements. A particularly simple and cost-effective connection of the drive lever can be realized in this way. In one embodiment example the receiving elements are implemented as lugs extending along a circular path, which engage the recesses of the legs after the legs of the drive lever have been pushed or clamped onto the receiving elements. It is also possible that the lugs are evenly formed only at the end of the circular projections along the circumference.

According to one embodiment the receiving elements are rigidly connected with the housing or integrally formed from the side wall of the housing. In one embodiment example the housing and the receiving elements are cast as one component. Alternatively, the receiving elements are connected with the housing by means of form or material closure.

According to one embodiment a cover each is provided for every side of the device, which engages an area surrounding the recesses and/or the recess itself and/or the receiving elements after the legs of the drive lever have been clamped onto the receiving elements and close the recess. The area surrounding the recesses also has recesses arranged on a circular path, which are implemented for receiving lugs of the cover and thus for fixing the cover to the device.

According to one embodiment the device has a spring element, which is implemented in a way to set the drive lever to a zero position. In a zero position of the drive lever the electric drive stands still. A manual actuation of the drive lever from the zero position will operate the electric drive in a drive position set to equal the position of the drive lever. When the drive lever is let go the drive lever can be moved back into the zero position. The spring element can be implemented in such a way that it moves the drive lever back into zero position in the forward and reverse operation of the electric drive when the drive lever is not operated by a user.

According to one embodiment the device has an arresting element, which is equipped to hold the drive lever in a zero position. The arresting element generates a force that will counteract the movement from the zero position with a suitably selected spring constant. In this way the user obtains haptic feedback in that the lever is moved from the zero position. The user also obtains the haptic feedback that the zero position is reached again when moving back into said zero position.

The arresting element further serves to prevent that the lever accidentally moves from the selected position. The arresting element provides protection against accidental adjustments, for example triggered by vibration or swell, especially if the drive lever is in the zero position.

This should be prevented in particular in applications with an electric motor in order to prevent that the electric motor is actuated without the user noticing, and correspondingly in particular drains the battery unnoticed whilst the electric motor is turning slowly. With a combustion engine this will not necessarily be the case, as acoustic feedback is also always provided here.

In one embodiment example the arresting element presses onto the side wall when the lever is actuated. This generates a friction force, which ensures that the lever remains in the selected position when the user lets go of the lever in this setting. In a further embodiment example the drive lever is not spring loaded and correspondingly remains in the position stipulated by the user due to the unavoidable friction of the components. This embodiment example can also be particularly well connected with an arresting element defining the zero position.

The inhibition of the drive lever through friction can also be realized with a defined friction means, which enables the provision of a specified haptic experience for the user, so that the same must always move the drive lever against a somewhat greater resistance.

According to one embodiment the device further has an input means and/or a display unit and/or a seal and/or a control unit and/or an on/off switch and/or a data cable, wherein these are arranged inside the housing.

In one embodiment example the input means is a foil keyboard.

The display unit is for example provided for the graphic illustration of information. The speed of the boat, the charging status of the battery and the expected reach of the boat, the utilized motor power and fault notifications from the power electronics can for example be displayed by means of the display unit. The drive lever and the display unit together form a drive control unit here.

The seal is for example provided for protecting the display unit against water ingress and is arranged between the top side of the housing and the display unit, wherein the top side of the housing has a recess for the display unit. A further seal can be provided on the underside of the display unit. A seal can also be provided between the top side of the housing and the display unit to protect the display against casting mass during a mold casting process of the housing.

In one embodiment example the control unit is a controller circuit board. The data cable is connected with the circuit board. The data cable transmits the power settings to the electric drive based on the position of the drive lever.

According to one embodiment the parts to be received by the housing are cast into the housing. The casting of the electronics of the device into the housing constitutes a particular effective protection of the electronics in humid environments.

According to another embodiment (not casted) a separate or integrated housing for the controller circuit board and/or the display unit is provided, possibly with a separate cover and a separate seal.

According to one embodiment an on/off switch in the form of a magnet pin, which is for example in connection with a round plate in connection with the control means, is provided. Once the magnet pin has been inserted into the specified space of the housing the device is switched on, or switched off, if the magnet pin is not inserted into the space. The round plate is made of a ferromagnetic material, for example of metal. A safe on/off switch can be provided in this way. The magnet pin therefore preferably serves as an emergency off switch, which can for example be provided in the form of a so-called "kill switch".

As an alternative to being inserted into the space the magnet pin can also be placed, clamped and/or magnetically held on a surface, for example a housing surface.

In a further embodiment example, a separate button can be provided on the foil keyboard as an on/off switch, or a separate switch can be provided as an on/off switch for the device.

According to one embodiment the device can be fitted to the boat with a bracket.

According to one embodiment the bracket is implemented as a sheet metal structure, wherein the housing is implemented in such a way that the housing can be pushed onto the bracket, e.g. that the device can for example be connected with the bracket via a snap & click connection. A rear-side screw connection is therefore not required on the bracket. The device can be easily mounted on the bracket in this way. The device can further be disconnected from the bracket or from the more easily, which is of advantage for the device. The sealing of the housing can also be simplified in this way, as no screw holes need to be provided for a screw connection.

In a further embodiment the sheet metal structure has two lugs, which engage and arrest two recesses on the front of the housing. Alternatively, the housing can additionally be connected with the bracket on the rear side.

The sheet metal structure can for example be fitted to a control stand of the boat with a screw connection, preferably with SPAX screws.

A boat with a device according to the above explanations is also suggested.

The drive lever can also have a self-arresting zero position, which can be realized through form elements such as spring pieces or suchlike, which for example engage depressions. All possible shapes such as depressions, links or suchlike and all possible form elements such as wedges, cones, rollers, half-cylinders etc. are feasible. All types of spring or force elements such as helical springs, leaf springs, rubber buffers and suchlike can also be used for the "locking force".

The zero positioning mechanism can also be provided through active or passive force elements such as magnets, electromagnets or other elements, which can apply a mechanical force to another element.

In one particularly advantageous embodiment a locking element (for example a wedge-shaped projection) can be provided, which engages a counter-contour (for example a wedge-shaped depression). The locking element can be implemented as a leaf spring and be implemented as a single piece in one or both legs, or as a single piece with the housing. The locking element can be molded onto one or both legs or the housing by means of an injection molding process.

In one particularly advantageous embodiment the drive lever therefore mechanically substantially consists of one or two moveable legs (levers), the fixed housing and a bracket as a possible mounting plate. All mounting and locking elements are preferably also molded on as arresting or snap hooks by means of plastic molding. This in particular also relates to the necessary elements of the zero position locking.

According to a further aspect of the invention a device for setting the drive position of an electric drive of a boat is suggested, having a housing with a receiving element arranged on a side wall of the housing, wherein the pivot axis extends through the receiving element and vertical to the central plane, and a receptacle of a drive lever that can be pivoted around this pivot axis, wherein the drive lever is received in a receiving element. The drive lever has a leg with a recess here, wherein the receiving element receives the drive lever via the recess, so that the drive lever can be pivoted in relation to the pivot axis. The drive lever is click-connected with the receiving elements of the housing here.

In one embodiment example the receiving elements have a length that is greater than the leg thickness in the direction of the pivot axis. Clickable means in this regard in particular that the receiving elements have fitting lugs. If the leg with the recess is guided across the receiving elements these will pass through the opening and the arresting lugs will pivotably arrest the leg on the housing. The leg can in particular not be pulled away from the housing in a pivot axis direction in this way, but remains there until the arresting lugs are either removed or are pressed back into the recess in a radial direction to the pivot axis, so that the leg can be removed once more.

Clickable can also mean that the receiving elements additionally press radially against the inside of the recess. This can generate friction in pivot direction. This means that a force effort is required to move the lever, so that an adjustment of the lever, for example through swell or suchlike, is not possible. The shape of the receiving elements further enables a determination of possible friction generated.

Further advantages and features of the present invention are apparent from the following description of preferred embodiment examples. The features described there can be realized individually or in combination with one or more of the features illustrated above as long as said features do not contradict each other. The following description of preferred embodiment examples relates to the enclosed drawings.

BRIEF DESCRIPTION OF THE FIGURES

Preferred further embodiments of the invention are explained in more detail in the following description of the Figures. These show.

DETAILED DESCRIPTION OF PREFERRED EMBODIMENT EXAMPLES

Preferred embodiment examples will be described in the following with reference to the Figures. Identical or similar elements, or those producing an identical effect are identified with identical reference numbers in the Figures, and a repeated description of these elements is partly omitted to avoid redundancies.

Figure 1:
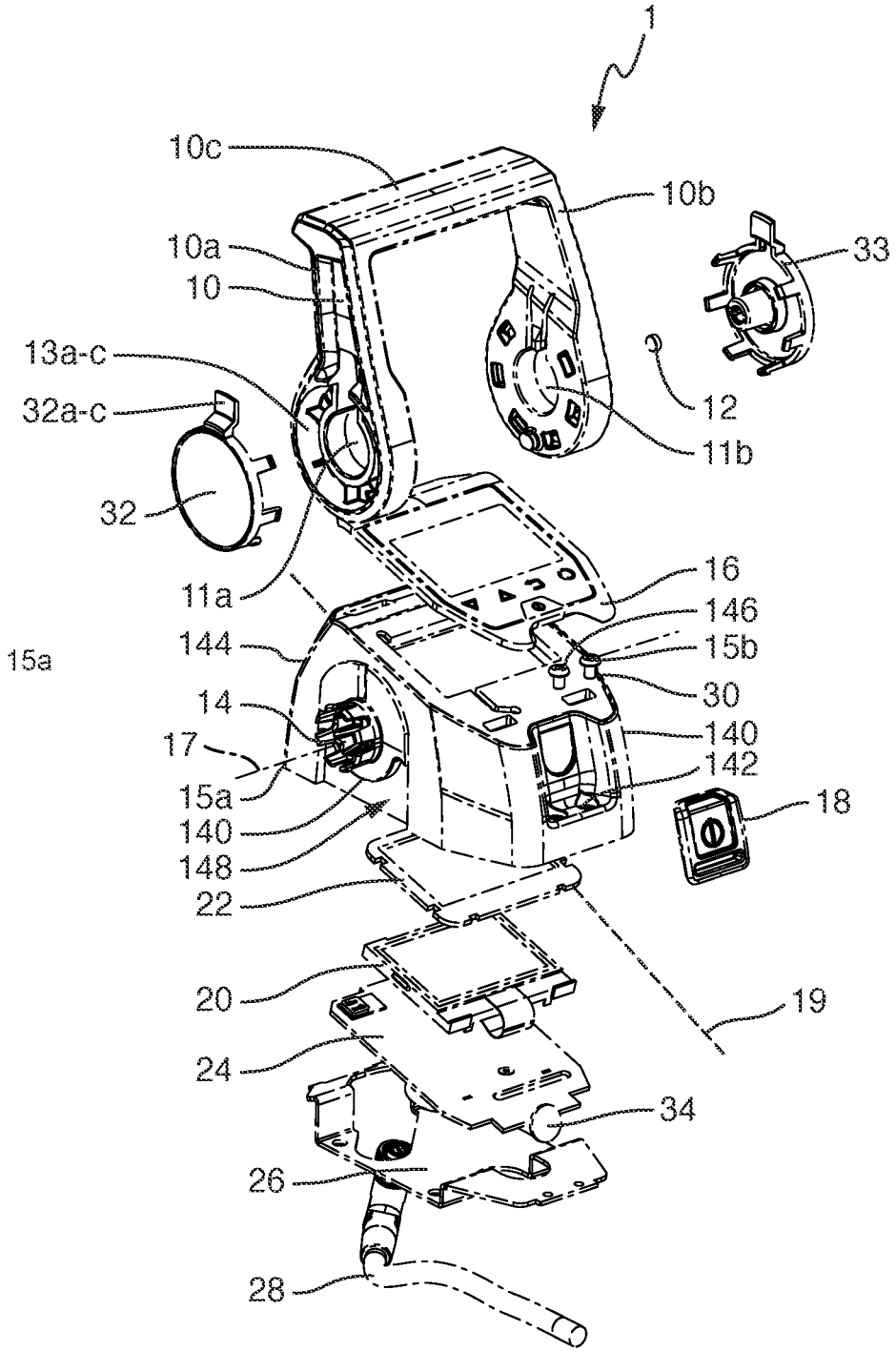
FIG. 1 a schematic exploded drawing of a device for setting the drive position of an electric drive according to one embodiment example.

FIG. 1 illustrates a device 1 for setting the drive position of an electric drive of a boat according to one embodiment example.

The device 1 has a drive lever 10 and a housing 14 with two opposing side walls 140, a front wall 142, a rear wall 144, a top side 146 and an underside 148.

Receiving elements 15*a*, 15*b* are each arranged on one of the two opposing side walls of the housing 14 on the two opposing side walls 140, wherein the receiving elements 15*a*, 15*b* are arranged opposite each other and are implemented in a way to fit the drive lever 10 to the housing to pivot around a pivot axis 17. The receiving elements 15*a*, 15*b* accordingly define a pivot axis 17 and are implemented in such a way that the drive lever 10 can be pivoted in relation to the pivot axis 17, wherein the drive lever 10 is received by both receiving elements 15*a*, 15*b*.

The drive lever 10 has two identically shaped legs 10*a*, 10*b*, which are connected with each other via a connecting bridge 10*c*, wherein the two legs 10*a*, 10*b* each have a recess 11*a*, 11*b*. The receiving elements 15*a*, 15*b* receive the legs 10*a*, 10*b* in the recesses 11*a*, 11*b*, so that the drive lever can be pivoted around the pivot axis. A twin-leg, preferably single-piece implementation of a drive lever like the one shown here allows the drive lever to be fitted to the housing in a simple way. A complex constructive mounting of the drive lever in the housing is not required.

In other words, the receiving elements 15*a*, 15*b* are arranged symmetrically opposite a central plane 19 of the housing shown in FIG. 1*a* and form the pivot axis 17 for the drive lever. The central plane denotes the plane that lies in the center of two side wall lying opposite each other.

According to a further embodiment example the drive lever 10 can be clicked onto the receiving elements 15*a*, 15*b* of the housing 14, so that the drive lever 10 is fixed in the axial direction of the pivot axis 17 and can be pivoted around the pivot axis 17.

In one embodiment example the legs 10*a*, 10*b* as well as the handle 10*c* are of a flexible bending implementation in order to stretch the legs 10*a*, 10*b* onto the receiving elements 15*a*, 15*b*. A clamping effect generated by the legs 10*a*, 10*b* of the drive lever can provide a simple and cost-effective connection with a drive lever 10. A complex connection of the drive lever with the housing is omitted.

In FIG. 1 the drive lever is shown as a U-shaped profile. The lever can however also have a trapezoidal shape. The recesses 15*a*, 15*b* are for example arranged in a lower area of the legs 10*a*, 10*b* wherein the lower area extends substantially vertical to the pivot axis 17. The drive lever 10 is further illustrated as a single-piece component. As shown in FIG. 1 the drive lever 10 resembles a clamp, quasi in the form of "headphones", which can be clamped onto the receiving elements of the housing.

The recesses 15*a*, 15*b* of the legs 10*a*, 10*b* are each implemented circular or as cylindrical recesses in the lower area of the leg. The radius of the recess 11*a*, 11*b* is implemented in such a way that it equals the radius of the receiving element 15*a*, 15*b* in such a way that the legs 10*a*, 10*b* can be pushed or clamped onto the receiving elements, so that the recesses 11*a*, 11*b* of the legs 10*a*, 10*b* of the drive lever 10 are in contact in a way that the drive lever can be pivoted in relation to the pivot axis 17. The clamping effect of the legs 10*a*, 10*b* and/or the pre-tensioning of the spring element (not shown) secure the drive lever against a loosening of the drive lever 10 along the axial direction of the pivot axis 17. The insides of the legs are preferably spaced apart from the side walls of the housings 14.

In a preferred embodiment the receiving elements 15*a*, 15*b* are cylindrical or hollow cylindrical projections, at the ends of which lugs are formed and circumferentially evenly distributed. The lugs have a hook-shaped form and engage behind the recess and additionally block the legs against displacement in an axial direction of the pivot axis 17 after the legs 10*a*, 10*b* have been pushed or clamped onto the receiving elements. The receiving elements 15*a*, 15*b* are preferably rigidly connected with the housing or integrally formed from the side wall of the housing 14.

The housing and the drive lever are preferably produced by means of a molding process, for example injection molding. In an alternative embodiment example, the housing is produced by means of a 3D printing method. The drive lever is for example also produced by means of a 3D printing method.

The area surrounding the recesses 11*a*, 11*b* on the circumference side has further evenly distributed recesses 13*a-n*. The recesses 13*a-n* serve for pushing a cover 32 onto the lower area of the legs 10*a*, 10*b*.

A cover each is preferably provided for every side of the device 1, which engages the area surrounding the recesses 11*a*, 11*b* and/or the recess itself and/or the receiving elements 15*a*, 15*b* after the legs 10*a*, 10*b* of the drive lever 10 have been clamped onto the receiving elements 15*a*, 15*b* and close the recess. FIG. 2*c* shows the drive lever 10 from the side in viewing direction of a side wall of the housing 14. The cover 32 closes the recesses of the legs after the drive lever 10 has been clamped or clicked onto the receiving elements 15*a*, 15*b* of the housing 14.

The cover 32 has a circular shape corresponding to the lower area of the legs 10*a*, 10*b* with lugs 32*a-n* projecting transverse from the circular plane of the cover on the circumference side. The lugs are implemented in a way that they engage the recesses 13*a-n* and cover the lower area of the legs 10*a*, 10*b*. The cover 32 further has a cone-shaped projection 33, which extends coaxially along a central line of the circular plane of the cover. The cone-shaped projection serves to prevent that the lugs 32*a-n* are put under too much strain when a force is applied from the side, e.g. in the direction of the central plane 19. If a force is for example applied to the lever from the side, the cone-shaped projection prevents that a leg of the lever jumps off the receiving elements.

The recesses 11*a*, 11*b* of the legs 10*a*, 10*b* of the drive lever 10 with the receiving elements 15*a*, 15*b* form a snap & click connection. A simple connection with the housing 14 can be provided with such an implementation of the drive lever 10. A complex connection of the drive lever 10 with the housing 14 is omitted.

As shown in FIG. 1 the device 1 further has an input means 16 and/or a display unit 20 and/or a seal 20 and/or a control unit 24 and/or an on/off switch 24 and/or a data cable 28, wherein these are arranged inside the housing 14.

At least one magnet 12 is arranged in the drive lever 10 and at least one sensor (not shown) is furthermore arranged in the housing 14 as shown by way of example in FIG. 1 in order to record the position change of the drive lever 10 around the pivot axis 17. The position change is transmitted to a control unit 24 here, which sets the drive position of the electric drive 102 (see FIG. 3) based on the position change of the drive lever 10. Based on the calculated position of the drive lever the electric drive is controlled with a specified power and/or torque and/or RPM. As shown here the at least one magnet 12 is arranged concentric to the pivot axis. When the drive lever 10 is pivoted the sensor calculates the rotation of the magnetic field of the magnet 12. The control unit 24 controls the electric drive 102 according to the power specified in relation to the calculated rotation change of the magnetic field of the magnet 12. The transmission of the signal of the power specified is transmitted to the electric drive (see FIG. 3) of the data cable 28.

Figure 2A:
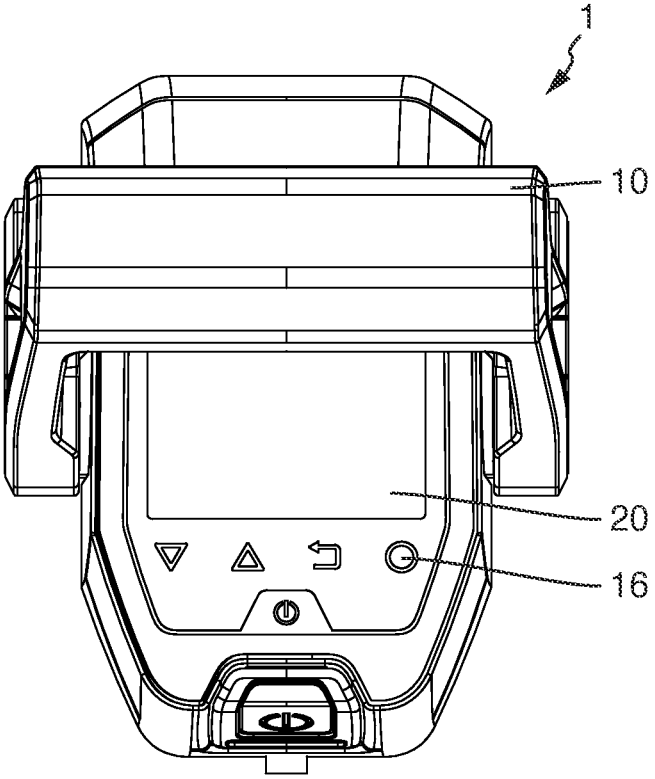
FIG. 2*a-e* various views of the schematically illustrated device for setting the drive position of an electric drive according to the embodiment example of FIG. 1.

In the embodiment example shown in FIG. 1 the input means is preferably a foil keyboard arranged on the top side of the housing 14 (see also FIG. 2*a*). The top side of the housing has a recess, which is implemented in such a way that the display unit 20, preferably a fully graphic display, is visible. The foil keyboard has a transparent area here, which substantially equals the size of the display unit 20.

A seal 22 is preferably provided to protect the display unit against water ingress 20. The seal 22 is arranged between the top side of the housing and the display unit 20. The display unit 20 and the foil keyboard 16 are connected with the control unit 24, preferably the controller circuit board. The control unit 24 is also implemented for calculating the position change of the at least one magnet 12 and for transmitting a power specification based on the same to the electric drive. The input means 16 and/or the display unit 20 and/or the seal 22 and/or the control unit 24 are arranged in the housing and connected to the housing with fitting means 30. Alternatively, the parts to be received by the housing are cast into the housing. Casting the electronics of the device into the housing enables a particularly efficient protection of the electronics in aggressive environments, for example salt water.

Figure 2B:
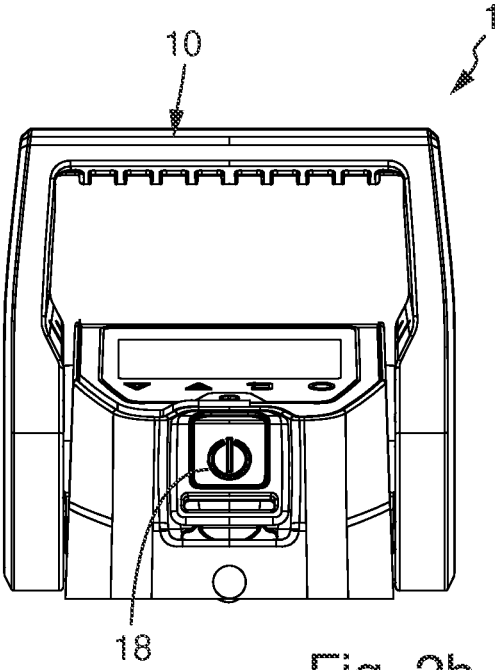
Figure 2C:
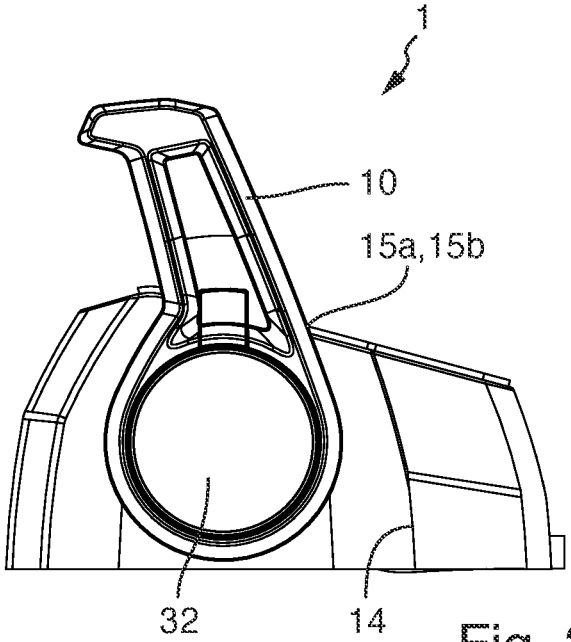

Shown as a further example the on/off switch 18 is a magnet pin (see also FIG. 2*b*), which is in magnetic connection with a round plate 34 connected with a control means. Once the magnetic pin 18 is inserted into the specified space of the housing the device is switched on, or switched off, if the magnet pin 18 is not inserted into the space. The round plate 34 is made of a ferromagnetic material, preferably metal. A safe on/off switch can be provided in this way.

Figure 2D:
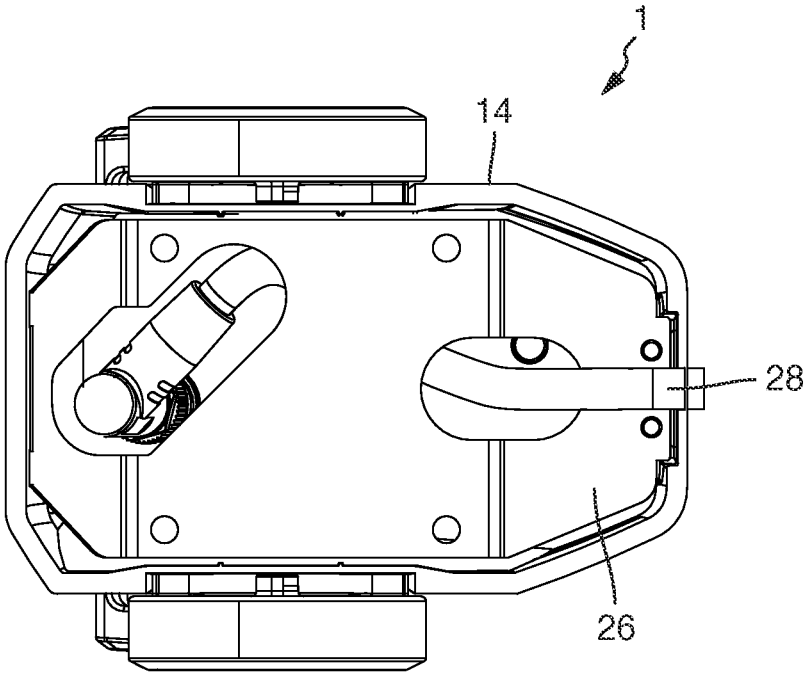
Figure 3:
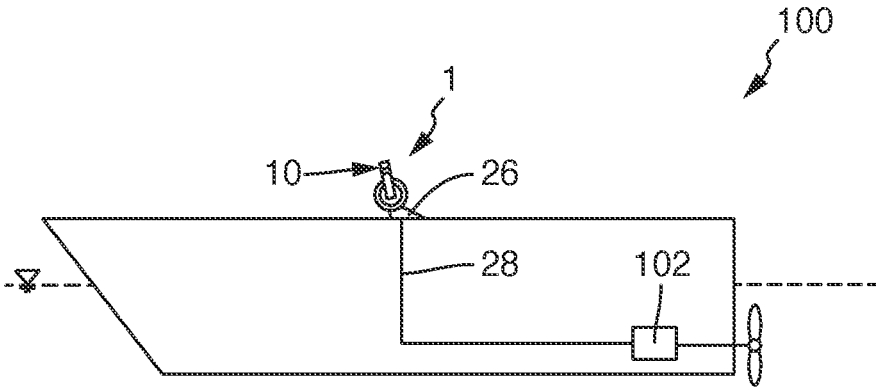
FIG. 3 a schematic illustration of a boat with a device for setting the drive position of an electric motor according to a further embodiment example.

The device can furthermore be fitted to the boat 100 via a bracket 26 (see also FIG. 3). As illustrated in FIG. 1*a* and FIG. 2*d* the bracket is implemented as a sheet metal structure, wherein the housing 14 is implemented in such a way that the housing 14 can be pushed onto the bracket 26. In this way the device can be mounted on the bracket in a simple way.

Figure 2E:
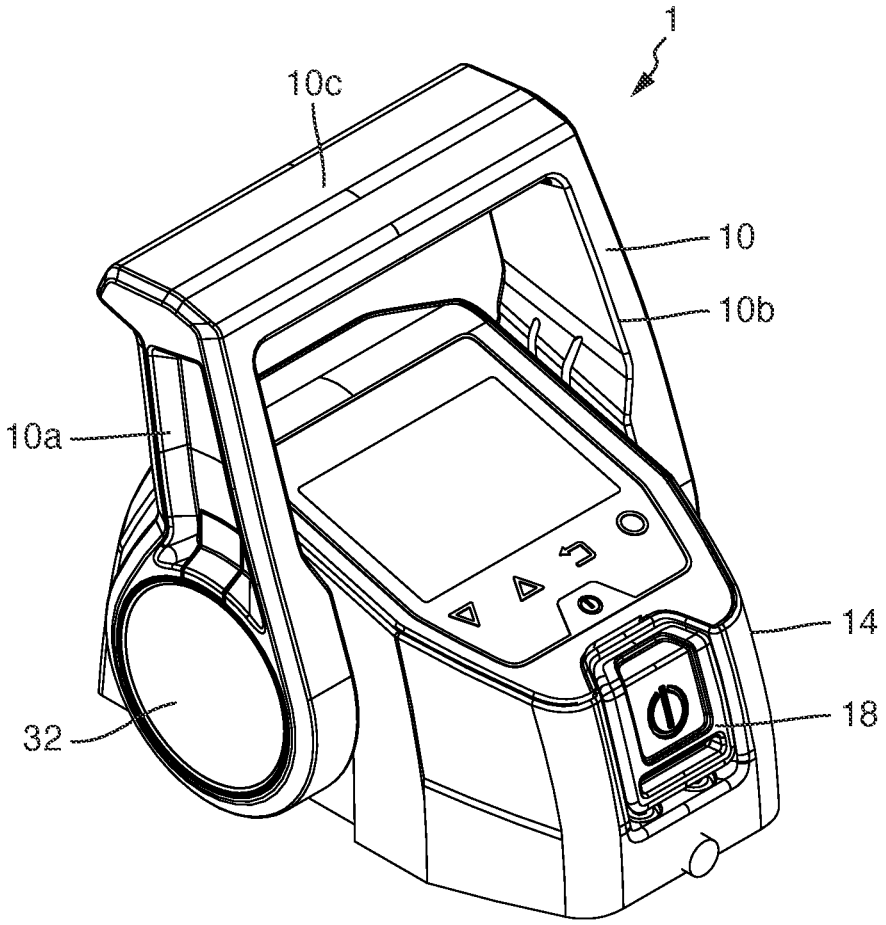

FIG. 2*e* shows a perspective view according to an embodiment example of the device.

Figure 4:
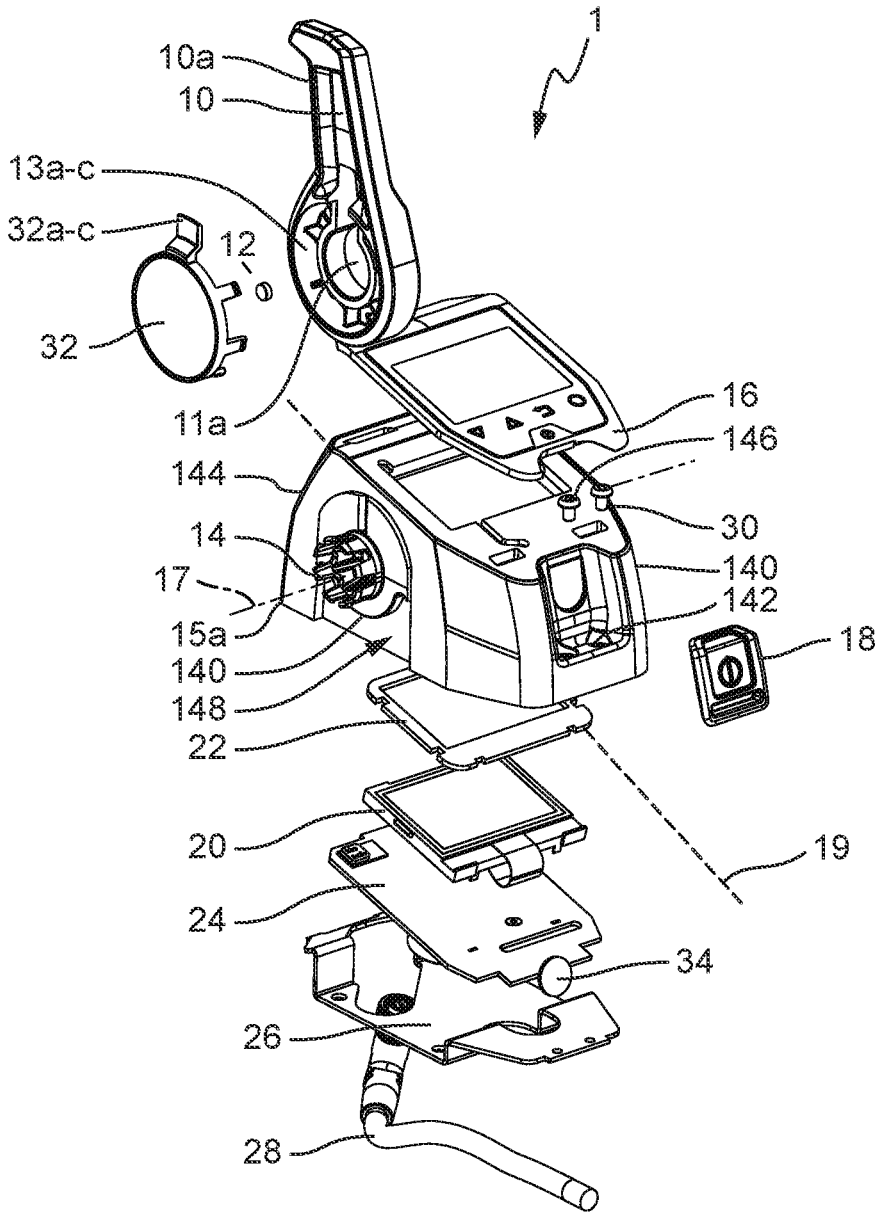
FIG. 4 a schematic exploded drawing of a device for setting the drive position of an electric motor according to a further embodiment example.

Like FIG. 1, FIG. 4 shows a device with just one leg of the drive lever. The leg 10 has a recess 11*a*, which can be guided across the receiving element 15*a*. The receiving element 15*a* has arresting lugs at the tips of the illustrated tabs. When the recess 11*a* is moved across the receiving element 15*a* the illustrated tabs are first radially bent in the direction of the pivot axis by the special, tapered shape of the arresting lugs. As soon as the recess 11*a* has been completely moved over the receiving element 15*a* the tabs move radially outwards, as no radial force is applied to the arresting lugs anymore. At the same time, it is realized that the arresting lugs fix the axial position of the leg 10. The tabs of the receiving element 15*a* further effect a radial outward force, so that friction or a frictional force is generated between the inside of the recess 11*a* and the receiving element 15*a*. The leg can therefore be moved only once the frictional force has been overcome by a user. This prevents that the leg is for example actuated during a strong swell. A frictional force further enables a more precise adjustment of forward propulsion, as the returning force forwards a haptic feedback regarding the leg position to the user.

Where applicable all individual features illustrated in the embodiment examples can be combined with and/or exchanged for each other without leaving the scope of the invention.

LIST OF REFERENCE NUMBERS

1 Control means
10 Drive lever
10*a*, 10*b* Leg
10*c* Connecting bridge
11*a*, 11*b* Recess
12 Magnet
13*a-n* Recesses
14 Housing
15*a*, 15*b* Receiving element
16 Input means
17 Pivot axis
18 Switch
20 Display unit
22 Seal
24 Control unit
26 Bracket
28 Data cable
30 Fitting means
32 Cover
32*a-n* Lugs
34 Round plate
100 Boat
140 Side wall
142 Front wall
144 Rear wall
146 Top wall

The invention claimed is:

1. A device for setting a drive position of an electric drive of a boat comprising:

a housing with one or more receiving elements arranged on one or more side walls of the housing for defining a pivot axis; and a drive lever that can be pivoted around this pivot axis, wherein the drive lever is received by the one or more receiving elements, wherein the drive lever includes two legs that are identically shaped, the two legs being connected with each other via a connecting bridge, wherein the two legs each include a recess, wherein the one or more receiving elements receive the drive lever in the recesses, so that the drive lever can be pivoted around the pivot axis, and wherein a cover is provided for every side of the device, wherein the cover engages an area surrounding one or more of the recesses, the recess itself, or the one or more receiving elements once the two legs of the drive lever have been clamped onto the one or more receiving elements and close the recess.

2. The device according to claim 1, wherein the drive lever comprises two identically shaped legs, which are connected with other via a connecting bridge, wherein the two legs each comprising a projection, wherein the projections engage the one or more receiving elements and receive the drive lever, so that the drive lever can be pivoted around the pivot axis.

3. The device according to claim 1, wherein the drive lever can be clicked onto or into the one or more receiving elements of the housing.

4. The device according to claim 1, wherein the one or more receiving elements comprises two receiving elements arranged on two opposing side walls.

5. The device according to claim 1, wherein at least one magnet is arranged in the drive lever and at least one sensor is arranged in the housing in order to record a pivot position of the drive lever around the pivot axis.

6. The device according to claim 1, wherein the drive lever is formed as a single piece.

7. The device according to claim 1, wherein the recesses of the two legs of the drive lever form a snap & click connection with the one or more receiving elements.

8. The device according to claim 1, wherein the one or more receiving elements are rigidly connected with the housing or are integrally formed in the one or more side walls of the housing.

9. The device according to claim 1 further including a spring element or an arresting element, which is implemented in a way to hold the drive lever in a zero position.

10. The device according to claim 1 further comprising one or more elements selected from an input means, a display unit, a seal, a control unit, an on/off switch, or a data cable, wherein the one or more elements are arranged inside the housing and are received by the housing.

11. The device according to claim 10, wherein the one or more elements to be received by the housing are cast into the housing.

12. The device according to claim 10, wherein the on/off switch is a magnet pin in magnetic connection with a round plate that is in connection with the control unit.

13. A device for setting a drive position of an electric drive of a boat, comprising:

a housing with a receiving element for defining a pivot axis arranged on a side wall of the housing, wherein the pivot axis extends through the receiving element; and a drive lever, which is received on the housing to pivot around this pivot axis, wherein the drive lever comprises a leg, wherein the drive lever can be pivoted around the pivot axis and the drive lever can be clicked onto the or into the receiving element of the housing.

14. The device according to claim 13, wherein at least one magnet is arranged in the drive lever and at least one sensor is arranged in the housing in order to record a pivot position of the drive lever around the pivot axis.

15. The device according to claim 13, wherein the drive lever is formed as a single piece.

16. The device according to claim 13, wherein a recess of the leg of the drive lever forms a snap & click connection with the receiving element.

17. A device for setting a drive position of an electric drive of a boat comprising:

a housing with one or more receiving elements arranged on one or more side walls of the housing for defining a pivot axis;

a drive lever that can be pivoted around this pivot axis, wherein the drive lever is received by the one or more receiving elements; and one or more elements selected from an input means, a display unit, a seal, a control unit, an on/off switch, or a data cable, wherein the one or more elements are arranged inside the housing and are received by the housing, wherein the on/off switch is a magnet pin in magnetic connection with a round plate that is in connection with the control unit.

18. A device for setting a drive position of an electric drive of a boat comprising:

a housing with one or more receiving elements arranged on one or more side walls of the housing for defining a pivot axis; and a drive lever that can be pivoted around this pivot axis, wherein the drive lever is received by the one or more receiving elements, wherein the drive lever can be clicked onto or into the one or more receiving elements of the housing.

* * * * *